US009211017B2

(12) United States Patent
Tyree

(10) Patent No.: US 9,211,017 B2
(45) Date of Patent: Dec. 15, 2015

(54) AIR FLOW MATTRESS CONSTRUCTIONS AND VARIABLE DENSITY MATTRESS CORES

(71) Applicant: Sealy Technology LLC, Trinity, NC (US)

(72) Inventor: Steven W. Tyree, High Point, NC (US)

(73) Assignee: Sealy Technology, LLC, Trinity, NC (US)

( * ) Notice: Subject to any disclaimer, the term of this patent is extended or adjusted under 35 U.S.C. 154(b) by 400 days.

(21) Appl. No.: 13/795,951

(22) Filed: Mar. 12, 2013

(65) Prior Publication Data

US 2014/0033440 A1 Feb. 6, 2014

Related U.S. Application Data

(60) Provisional application No. 61/678,145, filed on Aug. 1, 2012.

(51) Int. Cl.

| | |
|---|---|
| ***A47C 27/14*** | (2006.01) |
| ***A47C 21/04*** | (2006.01) |
| ***A47C 27/06*** | (2006.01) |
| ***A47C 27/15*** | (2006.01) |
| ***A47C 27/20*** | (2006.01) |

(52) U.S. Cl.

CPC ..... *A47C 21/042* (2013.01); *A47C 21/046* (2013.01); *A47C 27/064* (2013.01); *A47C 27/148* (2013.01); *A47C 27/15* (2013.01); *A47C 27/20* (2013.01)

(58) Field of Classification Search

CPC .. A47C 27/006; A47C 27/007; A47C 27/144; A47C 27/15; A47C 27/16; A47C 21/042; A47C 21/046; A47C 27/064; A47C 27/148; A47C 27/20

USPC ..... 5/691, 722, 724, 727, 728, 739, 740, 5/652.1, 714

See application file for complete search history.

(56) References Cited

U.S. PATENT DOCUMENTS

| | | | | |
|---|---|---|---|---|
| 3,110,042 | A * | 11/1963 | Slemmons | 5/728 |
| 4,292,703 | A * | 10/1981 | Goguen | 5/655.6 |
| 4,407,031 | A * | 10/1983 | Michiels | 5/728 |
| 5,590,428 | A * | 1/1997 | Roter | 5/726 |
| 6,061,856 | A * | 5/2000 | Hoffmann | 5/728 |
| 6,175,997 | B1 | 1/2001 | Mossbeck | |
| 6,286,167 | B1 * | 9/2001 | Stolpmann | 5/737 |
| 6,347,423 | B1 | 2/2002 | Stumpf | |
| 6,484,340 | B2 * | 11/2002 | Kutschi | 5/716 |
| 6,505,368 | B1 | 1/2003 | Ellis et al. | |
| 6,813,791 | B2 | 11/2004 | Mossbeck et al. | |
| 6,826,796 | B1 | 12/2004 | Mossbeck | |
| 7,076,822 | B2 | 7/2006 | Pearce | |
| 7,581,271 | B2 | 9/2009 | Gladney et al. | |

(Continued)

FOREIGN PATENT DOCUMENTS

| | | |
|---|---|---|
| CN | 202858509 U | 6/2012 |
| DE | 202007006721 U1 | 5/2007 |

(Continued)

*Primary Examiner* — Michael Trettel

(74) *Attorney, Agent, or Firm* — J. Mark Wilkinson

(57) ABSTRACT

The present disclosure and related inventions includes various mattress constructions with improved air flow characteristics, and in particular mattress constructions which induce or control air flow when force is applied to the mattress support surface.

13 Claims, 5 Drawing Sheets

(56) References Cited

U.S. PATENT DOCUMENTS

| | | | | |
|---|---|---|---|---|
| 7,865,989 | B2 * | 1/2011 | Steppat et al. | 5/740 |
| 8,191,187 | B2 * | 6/2012 | Brykalski et al. | 5/423 |
| 2006/0162082 | A1 * | 7/2006 | Kawahara et al. | 5/655.9 |
| 2011/0173757 | A1 * | 7/2011 | Rensink et al. | 5/698 |
| 2013/0232689 | A1 | 9/2013 | Young | |

FOREIGN PATENT DOCUMENTS

| | | |
|---|---|---|
| EP | 12166447.8 | 11/2012 |
| WO | WO2011/061270 | 5/2011 |

* cited by examiner

AIR FLOW MATTRESS CONSTRUCTIONS AND VARIABLE DENSITY MATTRESS CORES

RELATED APPLICATIONS

This application claims priority to U.S. Provisional Patent Application Ser. No. 61/678,145 filed on Aug. 1, 2012. The entire contents of the above-reference application are incorporated herein by reference.

FIELD OF THE INVENTION

The present disclosure and related inventions includes various mattress constructions with improved air flow characteristics, and in particular mattress constructions which induce or control air flow when force is applied to the mattress support surface.

BACKGROUND OF THE INVENTION

Mattresses of conventional constructions, whether of the innerspring, foam core or air-filled type, are designed for use in a static condition, without any change in support characteristics. Extensive use of foams, such as closed-cell polyurethane foam, visco-elastic foam and latex foam, whether in the upper comfort layers or as the core as the entire mattress body severely restricts air flow and accumulates and holds body heat. Perforations in foam layers of a mattress allow greater air contact but does not enable air to flow entirely through the mattress.

SUMMARY OF THE INVENTION

The present disclosure and related inventions describe various mattress constructions with improved airflow characteristics. In one embodiment the mattress includes a mattress core, a mattress topper located at the uppermost planar surface of the mattress, the mattress topper comprising one or more layers of foam, and a plurality of air flow passages in the form of elongate tubes located between the mattress core and the mattress topper, each air flow passage having at least one intake and an exhaust, the exhaust having a valve which operates as a one-way valve to allow air to escape the air flow passage. In another embodiment, the mattress includes a mattress core, a mattress topper located at the uppermost planar surface of the mattress, the mattress topper comprising one or more layers of foam, and a spacer fabric located between the mattress core and mattress topper, the spacer fabric having a plurality of valves disposed in an array on an upper surface of the spacer fabric, each of the plurality of valves having a generally circular opening which is hinged for opening and closing and an actuator which when opened allows air to escape the mattress. In yet another embodiment, the mattress includes a mattress core having two or more layers of foam material, air, springs or a combination thereof, an intermediate layer having a plurality of openings adapted to receive an insert, and a plurality of inserts in extruded form inserted into each of the plurality of transverse openings.

DETAILED DESCRIPTION

Figure 1:
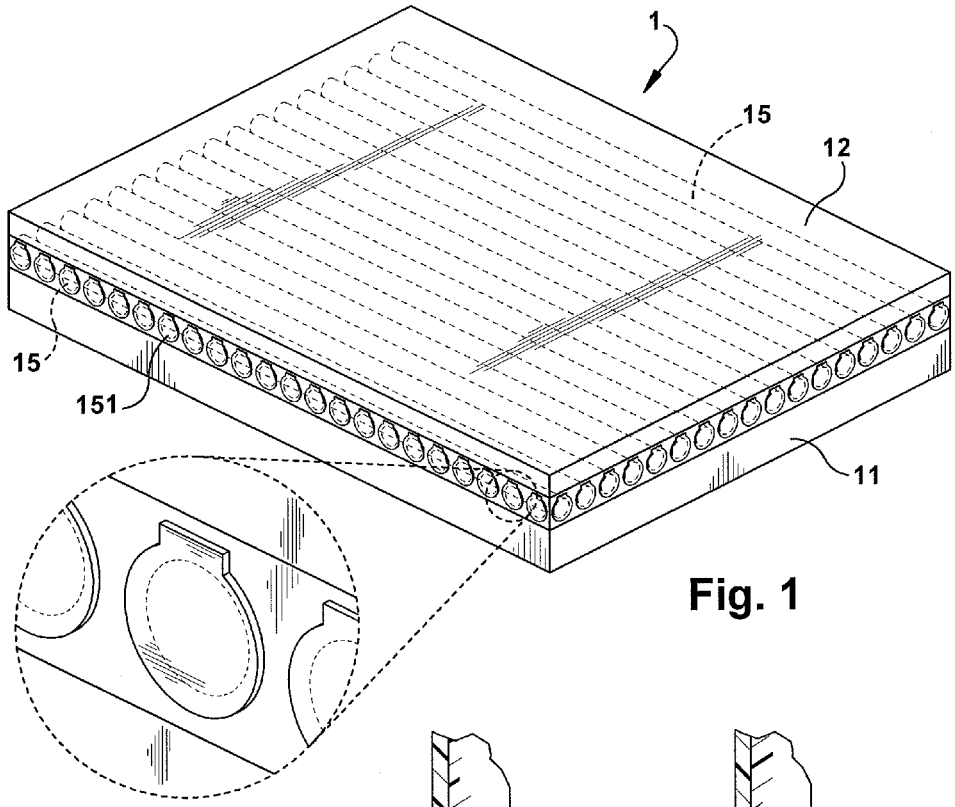
FIG. 1 is a perspective view of the mattress of the present invention.
Figure 2:
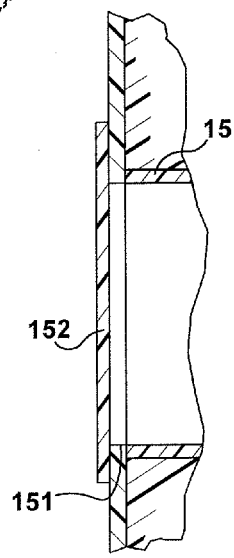
FIG. 2 is a profile view of the mattress of FIG. 1, with closed valve.
Figure 3:
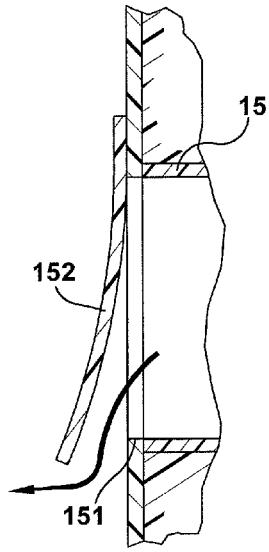
FIG. 3 is a profile view of the mattress of FIG. 1, with an open valve.

FIGS. 1-3 illustrate one embodiment of the present disclosure wherein a mattress 1 has a core 11 which may be made of a solid block of foam or layers of foam, or which alternatively could be an innerspring core or be comprised of one or more air bladders. A topper or comfort layer 12 provides the uppermost planar surface for body support, and can also comprise one or more layers of foam of the same or different type of core 11. Foam layers can be made of polyurethane foam, visco-elastic foam, foam which contains natural or synthetic latex or other additives. The foam may be open or closed cell or reticulated. The core 11 and/or topper 12 may be formed with perforations which extend partially or entirely through the cross-section of the layers.

In between the core 11 and topper layer 12 is an array of air flow passages 15, which in this embodiment are shown as generally elongate tubes which traverse the width of a the mattress 1, but which may alternatively traverse the length of the mattress 1, or both. The air flow passages 15 are made of flexible material or even fabric such as coated fabric, and can be embedded in a layer of foam between layers 11 and 12 or otherwise held in position and subject to variable compression by forces applied to the top body supporting surface of layer 12. Each passage 15 has at least one intake, which may be for example at one end of the passage or at one or more points along the length of the passage, for example in the interior of the mattress 1, and an exhaust which may be at an opposite end of the passage or also along the length of the passage in the interior of the mattress. In the embodiment shown, an exhaust end 151 is equipped with a valve 152 such as a flapper style valve which operates as a one-way valve to allow air to escape the passage 15. In this manner air is drawn into one or more passages 15 by vacuum effect when compressive force is relieved or reduced, thus increasing pressure in the passage and rendering that area of the mattress more supportive or firm due to increased air pressure under the comfort layer 12. When a minimum compressive force is thereafter applied in the region of a pressurized passage, the one-way valve 152 is opened and air pressure in the passage decreases, thus altering the support characteristics of the mattress in that region. The layer in which the passages 15 are located does not need to be impermeable, it only needs to have less permeability than the layer above it. Alternatively, the valves 152 at the foot end could open (outward), and valves 152 at the head end open inward to all a flow of air to pass through the mattress within that layer.

Figure 4:
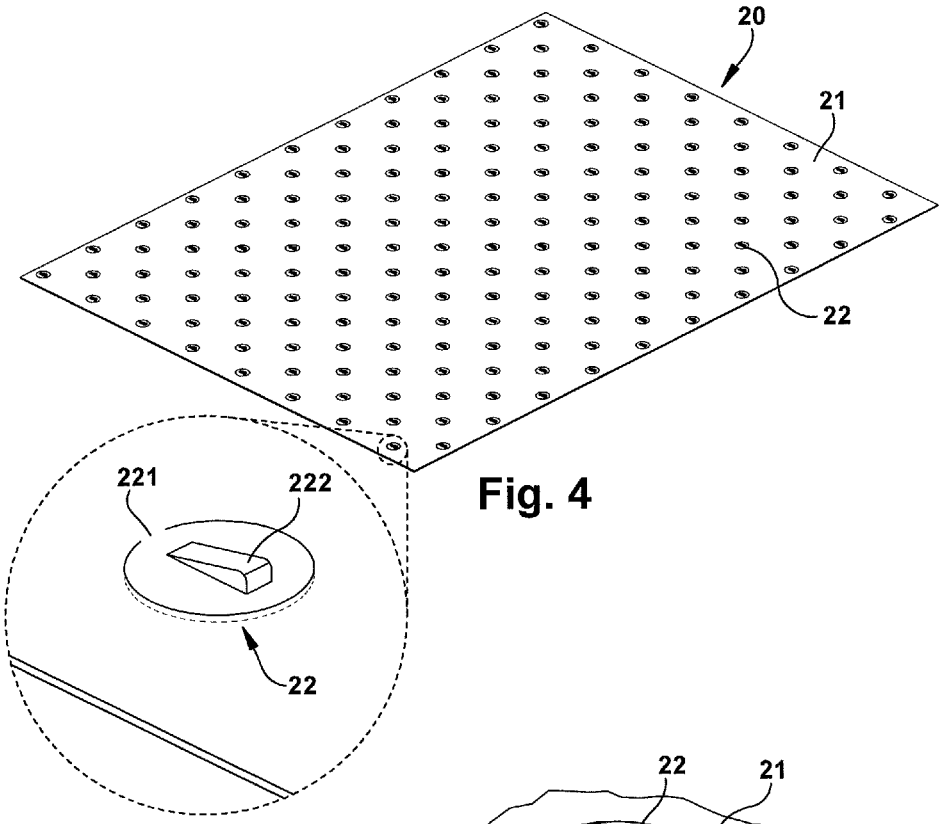
FIG. 4 is a perspective view of a passive air flow system for pneumatic variation and control of mattress firmness and feel.
Figure 5:
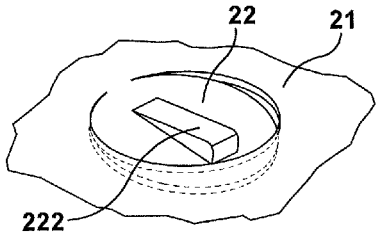
FIG. 5 is a close-up view of a valve of the passive air flow system of FIG. 4.

FIGS. 4 and 5 illustrate another type of passive air flow system for pneumatic variation and control of mattress firmness and feel. In this disclosure a layer 20 is configured for inclusion in a mattress build-up, such as in a foam core type mattress, innerspring mattress or air mattress or combinations thereof. The layer 20 can be formed of spacer fabric and with a sheet layer covering on one or both sides. In a material side of the layer 20, such as top side 21 which may be the sheet material, a plurality of valves 22 are disposed in a matrix or array. Each valve 22 may be for example in the form of a generally circular opening through the material of side 21, and hinged at 221 for opening and closing action. An actuator 222 can be provided on the top of each valve 22. When the actuator 222 is contacted from above, for example by pressure applied from an overlying layer of foam or other material in the mattress, the valve is opened downward into layer 20, allowing air to escape and de-pressurizing that particular area of layer 20. The valves can be located in certain regions of the mattress, such as the head and foot regions, and oriented by location of the hinge 221, to induce air flow through the mattress by intake for example at the foot end, and exhaust and the head end in response to changing forces applied from above.

Figure 6:
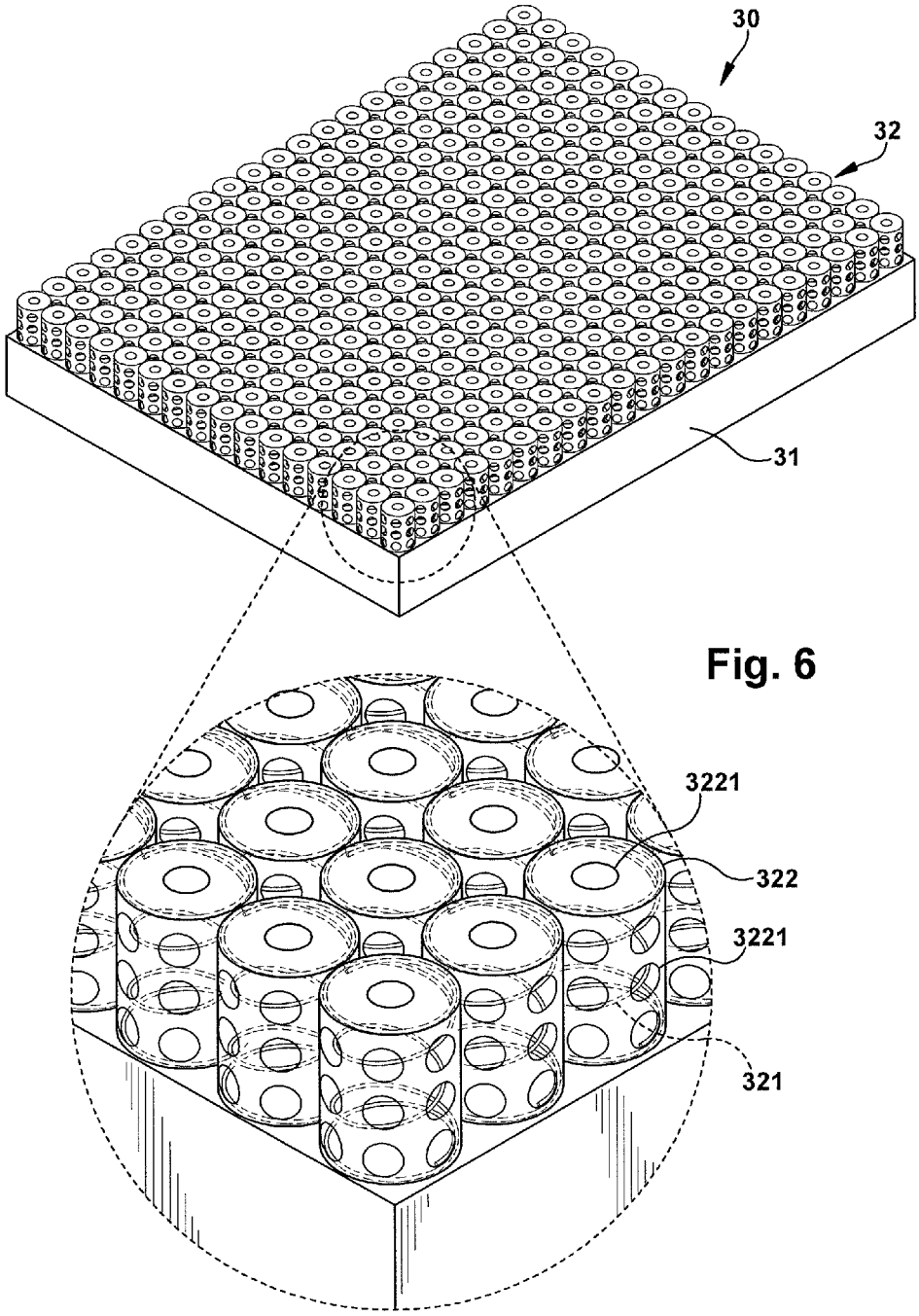
FIG. 6 is a perspective view of a hybrid type mattress core.

FIG. 6 illustrates a hybrid type mattress core, indicated generally at 30, which has improved air flow properties. The mattress core 30 includes a foam base 31 which may be comprised of one or more layers of foam, including polyurethane, visco-elastic or latex type foams of any suitable density and hardness. Arranged on a top surface of the foam base 31 is an array of springs 32, such as helical coil springs 321, each contained in a flexible enclosure 322 such as fabric or non-woven sheet material. Some or all of enclosures 322 of the springs 321 are formed with air ventilation holes 3221, both on the side of the enclosure, for example spaced about the cylindrical walls, and on the end or ends as shown. The ventilation holes 3221 dramatically increase the amount of air flow through the pocketed coil array. Each pocketed coil effectively pumps air throughout the upper region of the mattress, and into any layers which overlie the spring array 32. The ventilation holes 3221 may be of any size and in any number or arrangement. Alternatively, breathable fabric or perforated sheet materials may be used to allow and promote air flow through the spring array 32.

Figure 7:
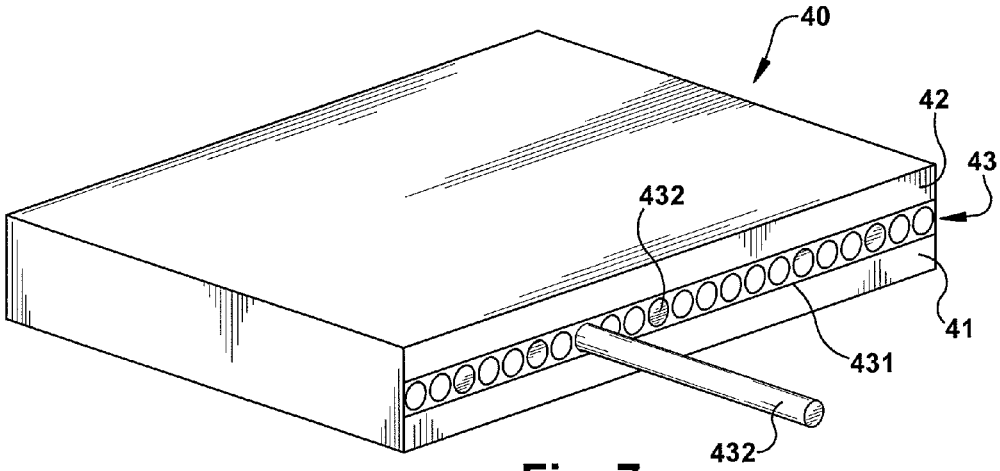
FIG. 7 is a perspective view of an alternate embodiment of a mattress core with circular inserts.
Figure 8:
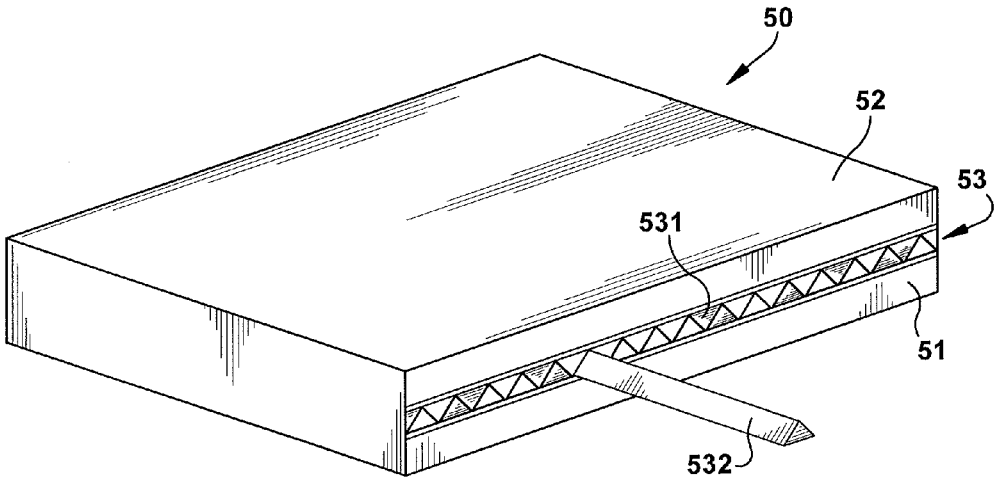
FIG. 8 is a perspective view of the mattress core of FIG. 7 with triangular inserts.

FIGS. 7 and 8 illustrate alternate embodiments of mattress core designs wherein the firmness or rigidity of the mattress can be altered according to one or more inserts which can be installed within the mattress core. As shown in FIG. 7, the mattress core 40 can be of one or more layers 41, 42 of foam material or air or springs or combinations thereof. An intermediate layer 43 has multiple transverse openings 431, shown traversing a width of the mattress core but which may alternatively extend longitudinally, and adapted to receive insert 432. The inserts 432 may be made of any suitable material, such as polyethylene foam in extruded form such as the generally cylindrical shape shown. The inserts 432 may extend an entire cross-sectional width of the mattress core 40, or there may be right half and left half inserts. The openings 431 can also be left open with no insert installed. FIG. 8 illustrates an alternate embodiment of this concept of the disclosure wherein the openings 531 and corresponding inserts 532 are generally triangular in cross-section. The inserts 532 with the bases of the triangles oriented upward provide a planar contact surface facing the overlying layer 52. The layer 43 may be made of relatively low density polyethylene, and the inserts 432 made of differing densities of polyethylene or other materials or alloys to allow for varying compressive behaviors of the layer. The layer 43 could be within the interior of the mattress as illustrated, or positioned at the bottom as a variable performance mattress base.

Figure 9:
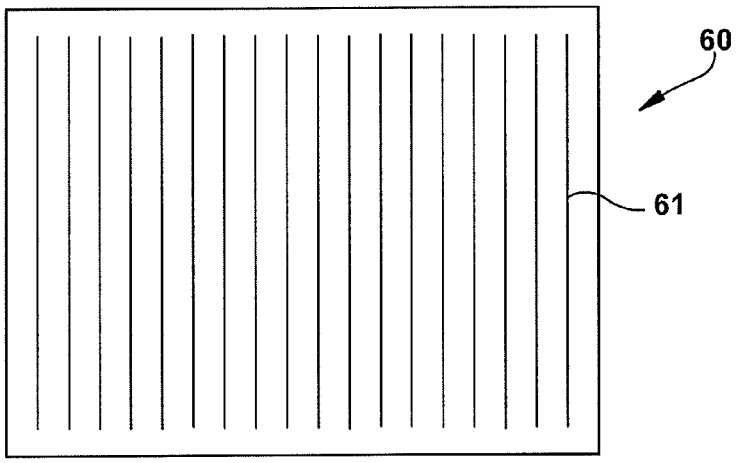
FIG. 9 is a top view of one embodiment of a spacer fabric.
Figure 10:
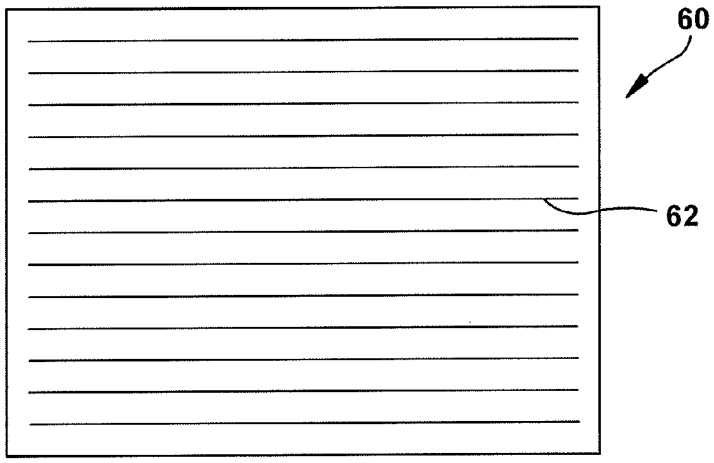
FIG. 10 is a top view of an alternate embodiment of a spacer fabric.
Figure 11:
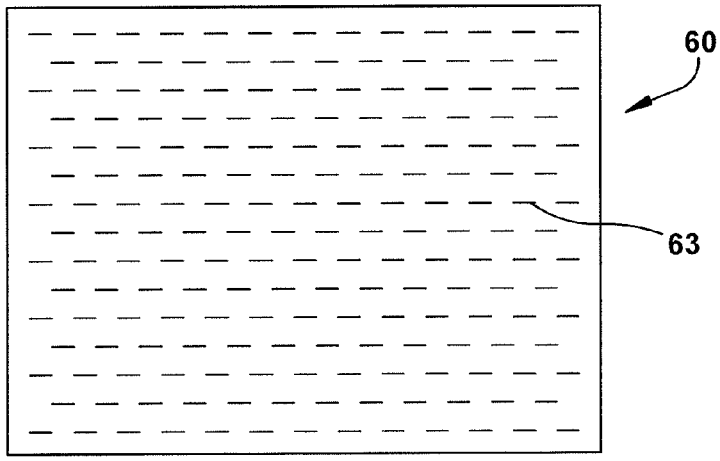
FIG. 11 is a top view of an alternate embodiment of a spacer fabric.

FIGS. 9-11 illustrate various embodiments of spacer fabric layers 60 with various configurations 61, 62 and 63 cut into the spacer fabric, in the form of generally vertically oriented cuts through or partially through a cross-section of the spacer fabric layer. These cut configurations increase flexibility and conformance of the spacer fabric layer and prevent bridging of the layer with respect to adjacent layers. By slitting the material parallel with the good elongation, the fabric will be allowed to open in the cross direction of minimal elongation, reduction the bridging effect of the spacer fabric. The types of spacer fabrics with which these cut configurations can be implemented include layers made of random fibers or continuous strands of bonded plastic filaments, fiber mats, woven and non-woven or any other open structure materials in sheet or planar form, wherein the cuts are made into the plane of the layer.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An air flow mattress comprising:

a mattress core;

a mattress topper located at the uppermost planar surface of the mattress, the mattress topper comprising one or more layers of foam;

a plurality of air flow passages in the form of elongate tubes located between the mattress core and the mattress topper, each air flow passage having at least one intake and an exhaust, the exhaust having a valve which operates as a one-way valve to allow air to escape the air flow passage.

2. The air flow mattress of claim 1, wherein the mattress core comprises one or more foam layers.

3. The air flow mattress of claim 1, wherein the mattress core comprises an innerspring.

4. The air flow mattress of claim 1, wherein the mattress core comprises one or more air bladders.

5. The air flow mattress of claim 1, wherein the mattress core and mattress topper may be made of polyurethane foam or visco-elastic foam.

6. The air flow mattress of claim 1, wherein the plurality of air flow passages are embedded in a layer of foam.

7. The air flow mattress of claim 1, wherein the plurality of air flow passages transverse transverse the width of the mattress.

8. The air flow mattress of claim 1, wherein the plurality of air flow passages transverse the length of the mattress.

9. An air flow mattress comprising: a mattress core; a mattress topper located at the uppermost planar surface of the mattress, the mattress topper comprising one or more layers of foam; a spacer fabric located between the mattress core and mattress topper, the spacer fabric having a plurality of valves disposed in an array on an upper surface of the spacer fabric, each of the plurality of valves having a generally circular opening which is hinged for opening and closing and an actuator which when opened allows air to escape the mattress.

10. The air flow mattress of claim 9, wherein each actuator is opened downward into the spacer fabric.

11. The air flow mattress of claim 10, wherein each actuator is opened by pressure applied from above by the mattress topper.

12. The air flow mattress of claim 9, wherein the plurality of valves is located at a head and foot region of the mattress.

13. The air flow mattress of claim 12, wherein the plurality of valves are oriented by the location of the hinge to induce air flow through the mattress by intake at the foot region of the mattress and exhaust at the head region of the mattress in response to changing forces applied from above.

* * * * *